US006600430B2

(12) United States Patent
Minagawa et al.

(10) Patent No.: US 6,600,430 B2
(45) Date of Patent: Jul. 29, 2003

(54) VEHICLE WIRELESS DATA COMMUNICATION SYSTEM

(75) Inventors: Shoichi Minagawa, Tokyo (JP); Kazuhiro Ido, Tokyo (JP)

(73) Assignee: Clarion, Co., Ltd., Tokyo (JP)

( * ) Notice: Subject to any disclaimer, the term of this patent is extended or adjusted under 35 U.S.C. 154(b) by 221 days.

(21) Appl. No.: 09/771,644

(22) Filed: Jan. 30, 2001

(65) Prior Publication Data

US 2001/0020891 A1 Sep. 13, 2001

(30) Foreign Application Priority Data

Jan. 31, 2000 (JP) ..... P.2000-021153

(51) Int. Cl.[7] ..... G08G 1/123

(52) U.S. Cl. ..... 340/988; 340/539.11; 340/539.23; 340/686.6

(58) Field of Search ..... 340/988, 539.1, 340/686.1, 686.6, 825.15, 825.25, 5.1, 5.2, 5.21, 5.22, 5.23, 5.8, 10.1, 10.34, 10.4, 539.11, 539.23; 307/10.1, 10.5; 701/2

(56) References Cited

U.S. PATENT DOCUMENTS 4,835,533 A * 5/1989 Akutsu ..... 340/5.72
4,942,393 A * 7/1990 Waraksa et al. ..... 340/825.72
5,794,164 A * 8/1998 Beckert et al. ..... 701/1
5,929,769 A * 7/1999 Garnault ..... 340/825.31
6,151,493 A * 11/2000 Sasakura et al. ..... 455/421
6,349,257 B1 * 2/2002 Liu et al. ..... 701/200
6,446,004 B1 * 9/2002 Cao et al. ..... 701/213

* cited by examiner

*Primary Examiner*—Toan Pham
(74) *Attorney, Agent, or Firm*—McGinn & Gibb, PLLC

(57) ABSTRACT

A vehicle wireless data communication system of the invention comprises: a portable device including wireless data communication means and storing means for storing a network setting-up code; and a vehicle carried device including wireless data communication means and storing means for storing a network setting-up code corresponding to the network setting-up code of the portable device, wherein when the portable device approaches to a position within a communication range of the vehicle carried device (S1), an inquiry communication is carried out to compare the network setting-up codes for verification (S2), and when the network setting-up codes are coincident with each other (S3, S5), a wireless link is set up and the vehicle carried device is rendered active (S6).

38 Claims, 3 Drawing Sheets

VEHICLE WIRELESS DATA COMMUNICATION SYSTEM

BACKGROUND OF THE INVENTION

The present invention relates to a vehicle wireless data communication system, and more particularly to a vehicle wireless data communication system in which when a portable device approaches to a position within a communication range of a vehicle carried device, a wireless link is automatically set up.

A vehicle wireless data communication system, of late, is proposed which contains a vehicle carried computer, and a combination of it with multi-media devices, such as an audio device, a navigation device, and an automatic toll paying device.

The proposed data communication system is arranged such that a portable device, e.g., a portable telephone set, is interconnected with a vehicle carried computer, and data communication is carried out between those devices.

Two communication connection systems, one based on the wire connection and the other based on the wireless connection by infrared rays, have practically been used for the mutual communication between the portable device and the vehicle carried computer. Both the communication connection systems need connection devices each called a cradle. Where the cradle is used, a user must set the portable telephone to the cradle every time he gets in a car, and must remove the portable telephone from it every time he gets off the car. Accordingly, the use of the cradle is insufficient in convenience.

In the communication connection system using the infrared rays for data exchange, it is necessary, in use, to align the optical axis of the transmitter side with that of the receiving side. This is awkward in use.

This type of the computer is generally expensive. Accordingly, a system to protect the computer against the burglar is proposed. The proposed system uses a pass word. Even if the power switch of the computer is turned on, the computer will not operate normally unless a correct pass word is entered.

The proposed system, however, requires troublesome work of entering the pass word every time the use gets in the car.

To cope with this, a burglarproof device has practically been used. This device uses a device operation plate, called a face plate. In use, the user removes the portable device from it when he gets off the car. When getting to the car, the portable device is set to it again. With use of this device, it is prevented that only the computer unit is stolen. The burglarproof device needs a number of connection wires for connecting the face plate to the computer unit for their mutual communication. A connector having a number of pins is consequently required. The burglarproof device has many disadvantages. Poor contact trouble will occur. The multi-pin connector is expensive. Great spatial limitation is present in installing the face plate.

As the result of the advent of the vehicle carried computer, various systems utilizing the vehicle carried computers are proposed in recent years. A proposed system is an emergency reporting system in which when a traffic accident occurs, the accident is reported to a service center by the utilization of the telephone function. Another proposed system is a payment system which allows the user to electronically pay tolls and the prices at expressways, gas stations, drive-through fast food restaurants and the like, in a drive-through manner.

In those systems, it is very important that the device operation is simple since the user must operate the device while driving the car.

SUMMARY OF THE INVENTION

Accordingly, an object of the present invention is to provide a vehicle wireless data communication system which allows mutual communication between the portable device and the vehicle carried device, which the system is improved in that the device operation is simple.

A first vehicle wireless data communication system of the invention comprises: a portable device including wireless data communication means and storing means for storing a network setting-up code; and a vehicle carried device including wireless data communication means and storing means for storing a network setting-up code corresponding to the network setting-up code of the portable device, wherein when the portable device approaches to a position within a communication range of the vehicle carried device, an inquiry communication is carried out to compare the network setting-up codes for verification, and when the network setting-up codes are coincident with each other, a wireless link is set up and the vehicle carried device is rendered active (aspect 1).

In a second vehicle wireless data communication system which depends from the first vehicle wireless data communication system, when the vehicle carried device is rendered active, a burglarproof lock system of the vehicle carried device is removed (aspect 2).

In a third vehicle wireless data communication system which depends from the first vehicle wireless data communication system, when the portable device has a telephone function, if a call is terminated, a hands free mode is automatically set up (aspect 3).

In a fourth vehicle wireless data communication system which depends from the first vehicle wireless data communication system, when the portable device has a telephone function and an emergency reporting service connection function, self vehicle position data, which is detected by a GPS of the vehicle carried computer, is automatically sent to the portable device, and the portable device connects to an emergency reporting service (aspect 4).

In a fifth vehicle wireless data communication system which depends from the first vehicle wireless data communication system, when the portable device has a PDA (personal information assist device, electronic notebook and the like) function, the portable device makes a data exchange of schedule data, personal information, stored digital information and the like with the vehicle carried device (aspect 5).

In a sixth vehicle wireless data communication system which depends from the first vehicle wireless data communication system, when the portable device has a PDA (personal information assist device, electronic notebook and the like) function, the portable device sends at least part of personal information, such as credit card information and electronic money information, contained in the portable device, to the vehicle carried device, and in the payment operation at a tollgate of expressway, gas station and the like, payment is carried out based on a verification of the personal identification data by data exchange between the vehicle carried computer and the portable device (aspect 6).

In a seventh vehicle wireless data communication system which depends from the first vehicle wireless data communication system, when a wireless link is not set up, an intermittent inquiry communication, triggered from the vehicle carried device, is carried out (aspect 7).

In an eighth vehicle wireless data communication system which depends from the seventh vehicle wireless data communication system, the intermittent inquiry communication is started upon detection of a voltage applied in association with an operation of a vehicle engine key (aspect 8).

In a ninth vehicle wireless data communication system which depends from the seventh vehicle wireless data communication system, the intermittent inquiry communication is started in response to an output signal of a vehicle door opening/closing switch or an output signal of a getting-to-vehicle detecting sensor, such as a seat weight sensor or an infrared rays sensor (aspect 9).

A tenth vehicle wireless data communication system comprises: a portable device including wireless data communication means and storing means for storing a network setting-up code; and a vehicle carried device including wireless data communication means and storing means for storing a network setting-up code corresponding to the network setting-up code of the portable device, wherein when the portable device approaches to a position within a communication range of the vehicle carried device, an inquiry communication is carried out to compare the network setting-up codes for verification, and when the network setting-up codes are coincident with each other, a wireless link is set up, and when personal identification codes are coincident with each other, the vehicle carried device is rendered active (aspect 10).

In an 11th vehicle wireless data communication system which depends from any of the first to tenth vehicle wireless data communication systems, when the vehicle carried device is rendered active, the active state of the vehicle carried device is audibly output (aspect 11).

In a 12th vehicle wireless data communication system which depends from any of the first to 11th vehicle wireless data communication systems, when the vehicle carried device is rendered active, a message based on personal information recorded in advance is output (aspect 12).

In a 13th vehicle wireless data communication system which depends from any of the first to 12th vehicle wireless data communication systems, when the vehicle carried device is rendered active, a custom operation of the vehicle carried device, which is based on personal information recorded in advance is output, is set (aspect 13).

In a 14th vehicle wireless data communication system which depends from any of the first to 13th vehicle wireless data communication systems, when the vehicle carried device is rendered active, a time that the vehicle carried device is rendered active is stored (aspect 14).

In a 15th vehicle wireless data communication system which depends from any of the first to 14th vehicle wireless data communication systems, the wireless data communication means has a network communication function (aspect 15).

In a 16th vehicle wireless data communication system which depends from any of the first to 15th vehicle wireless data communication systems, a plurality of network setting-up codes are contained, and different setting-up information are assigned to the plurality of network setting-up codes, respectively (aspect 16).

In a 17th vehicle wireless data communication system which depends from any of the first to 16th, the plurality of network setting-up codes are associated with device operation limits (aspect 17).

In a 18th vehicle wireless data communication system which depends from any of the first to 17th vehicle wireless data communication systems, the portable device moves out of a communication range of the vehicle carried device, the wireless link is disconnected and the vehicle carried device is turned off (aspect 18).

In a 19th vehicle wireless data communication system which depends from any of the first to 18th vehicle wireless data communication systems, the portable device moves out of a communication range of the vehicle carried device, the wireless link is disconnected and a burglarproof lock is set (aspect 19).

In a 20th vehicle wireless data communication system which depends from any of the first to 19th vehicle wireless data communication systems, the portable device moves out of a communication range of the vehicle carried device, the wireless link is disconnected and part of the personal information which was set when the wireless link is set up (aspect 20).

In a 21st vehicle wireless data communication system which depends from any of the first to 20th, the portable device moves out of a communication range of the vehicle carried device, the wireless link is disconnected and a time that the portable device is out of the communication range is stored (aspect 21).

In a 22nd vehicle wireless data communication system which depends from any of the first to 21st vehicle wireless data communication systems, the portable device is a removable face plate of the vehicle carried device (aspect 22).

In a 23rd vehicle wireless data communication system which depends from the 22nd vehicle wireless data communication system, the face plate has a wireless telephone function (aspect 23).

In a 24th vehicle wireless data communication system which depends from the 22nd vehicle wireless data communication system, the face plate has a personal information recording function (aspect 24).

DETAILED DESCRIPTION OF THE PREFERRED EMBODIMENTS

The preferred embodiments of the present invention will be described with reference to the accompanying drawings.

Figure 1:
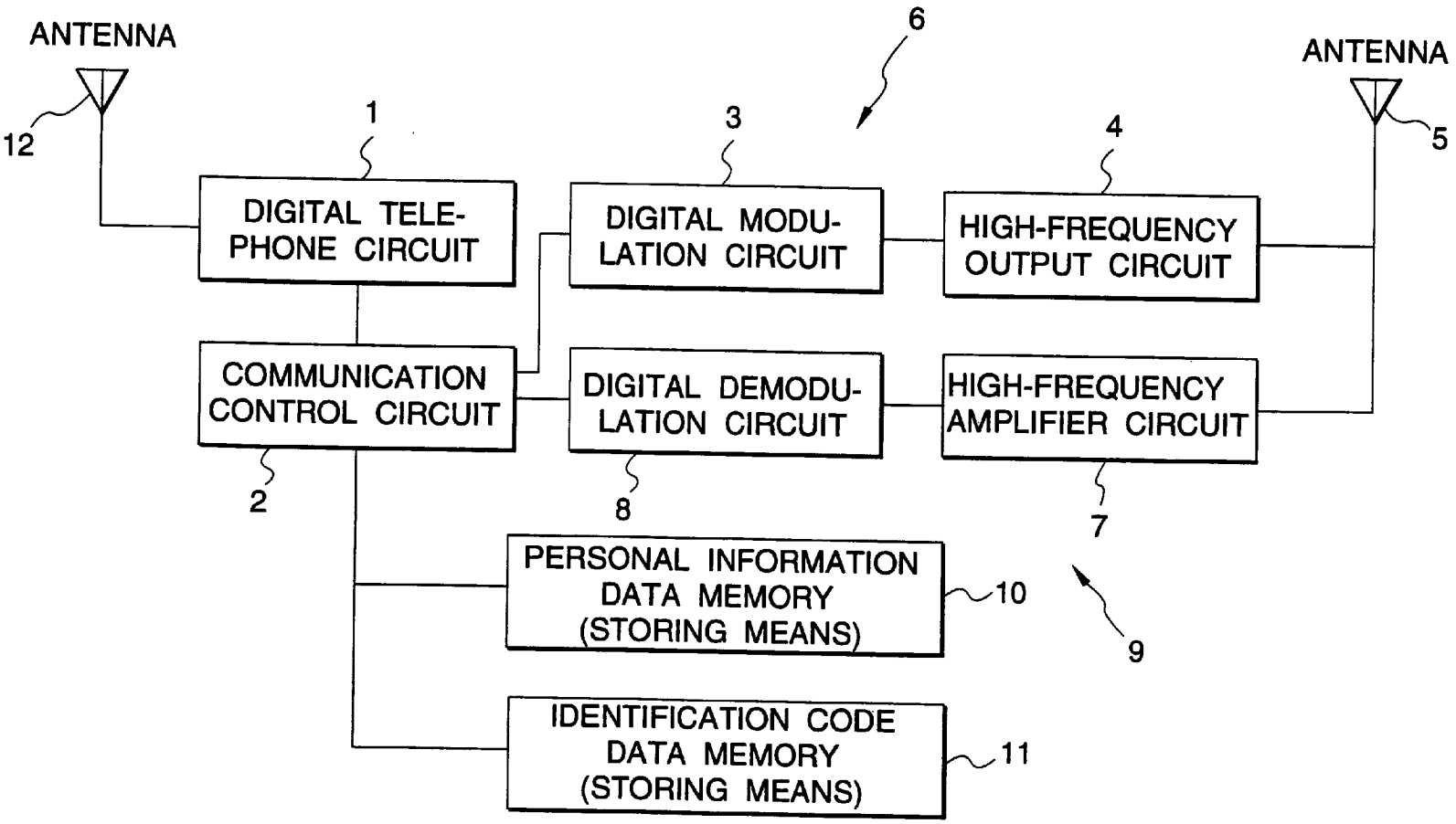
FIG. 1 is a block diagram showing an embodiment of a vehicle wireless data communication system according to the present invention.
Figure 2:
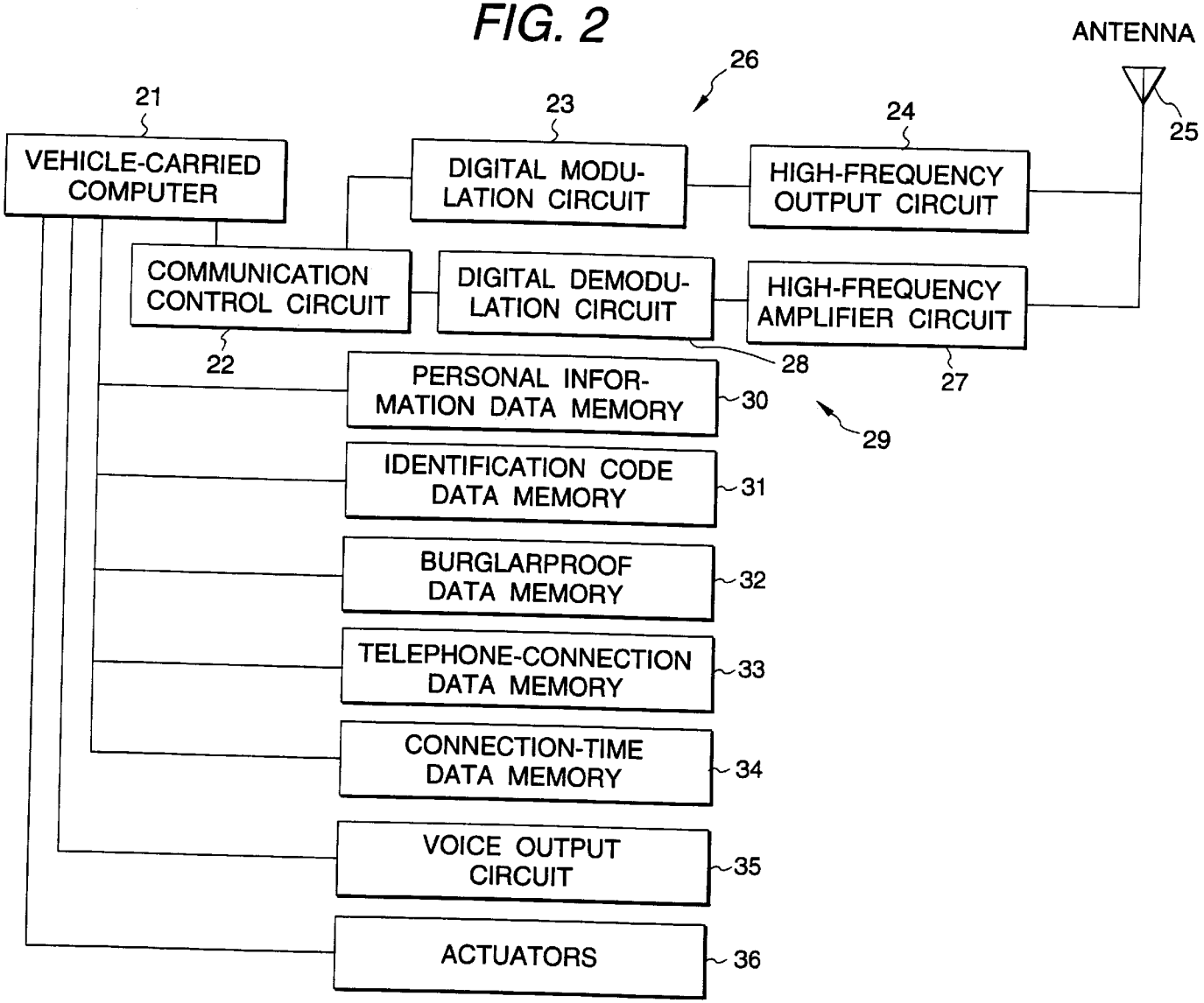
FIG. 2 is a block diagram showing a portable side in the vehicle wireless data communication system.

A system to be described is a vehicle wireless data communication system in which mutual communication is wirelessly carried out between a portable device (e.g., a portable telephone set) shown in FIG. 1 and a vehicle carried device (e.g., a vehicle carried computer) shown in FIG. 2.

In FIG. 1, the portable telephone set has a digital telephone function (digital telephone circuit) and a wireless data communication function. A digital telephone circuit 1 is connected to a communication control circuit 2. The communication control circuit 2 is connected to a transmitting circuit 6 which includes a digital modulation circuit 3, a high-frequency output circuit 4 and an antenna 5, and a receiving circuit 9 which includes an antenna 5, a high-frequency amplifier circuit 7 and a digital demodulation circuit 8. The communication control circuit 2 is further connected to a personal information data memory (storing means) 10 for storing personal identification codes and the like and an identification code data memory (storing means) 11 for storing network setting-up codes and the like. Reference numeral 12 designates an antenna of the portable telephone set.

In FIG. 2, the vehicle-carried computer 21 is connected to a communication control circuit 22 which enables the computer to wirelessly communicate with the portable telephone set of FIG. 1. The communication control circuit 22 is connected to a transmitting circuit 26 which includes a digital modulation circuit 23, a high-frequency output circuit 24 and an antenna 25, and a receiving circuit 29 which includes an antenna 25, a high-frequency amplifier circuit 27 and a digital demodulation circuit 28.

The vehicle-carried computer 21 is connected to a personal information data memory (storing means) 30 for storing personal identification codes and the like, and identification code data memory (storing means) 31 for storing network setting-up codes and the like. The same is further connected to a burglarproof data memory 32, a telephone-connection data memory 33, a voice output circuit 35, and various types of actuators 36. Those actuators 36, not shown, are used for adjusting seat positions, inclinations of seat recliners, angles of door mirrors, temperature of the air conditioner, amount of blowing air, and the like.

Examples of the possible devices to be combined with the vehicle-carried computer 21 are multi-media devices, such as an audio device, a navigation device, and an automatic payment device.

Figure 3:
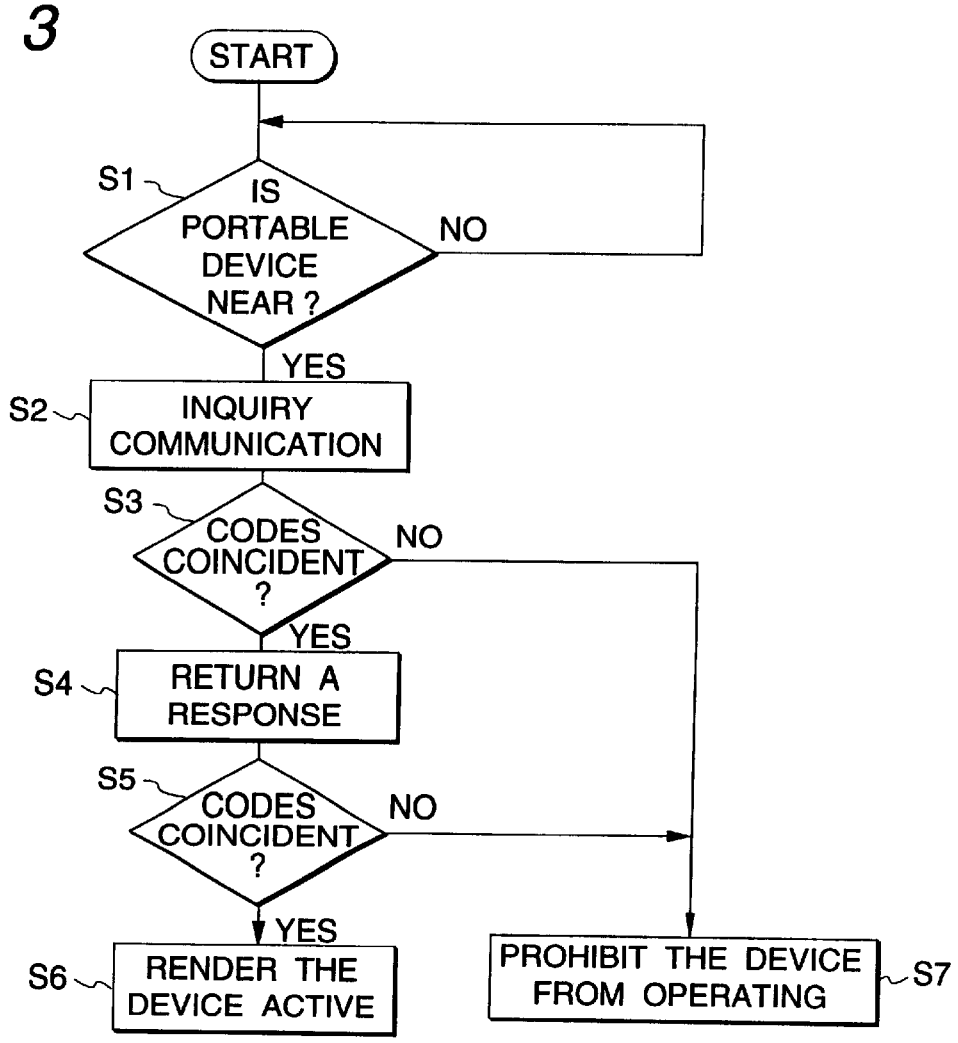
FIG. 3 is a flow chart showing an operation of the vehicle wireless data communication system.

Operations of the vehicle wireless data communication system thus constructed will be described with reference to FIG. 3.

In the vehicle wireless data communication system of the embodiment, a person carrying the portable telephone set of FIG. 1 gets to the vehicle. When the portable telephone set is located within a communication range of the vehicle-carried computer 21 (S1), an inquiry communication for setting up a wireless link is carried out (S2).

In the inquiry communication, an inquiry code is intermittently transmitted from one of the vehicle-carried computer 21 and the portable telephone set is transmitted to the other.

In the case, if the transmitting side is always put in a transmitting state, electric power is consumed for the transmission. This leads to reduction of the effective operation time of the power supply, e.g., a battery. When the sending of an inquiry signal at intervals of several seconds will do as in this embodiment, it is desirable that the inquiry communication is sent from the vehicle-carried computer 21. The reason for this is that a battery of a relatively large capacity is exclusively used for the vehicle-carried computer 21, and power source is supplied from the battery in transmitting the inquiry signals.

In the inquiry communication, in response to the network setting-up code signal transmitted from the vehicle-carried computer 21, the receiving circuit 9 of the portable telephone set of FIG. 1, which is made up of he antenna 5, the high-frequency amplifier circuit 7, the digital demodulation circuit 8 and the communication control circuit 2, recognizes the network setting-up code, and compares it with a network setting-up code that is stored in the identification code data memory 11 (S3).

When those network setting-up codes are coincident with each other, the portable telephone set sends out a return signal containing the network setting-up code that is stored in the identification code data memory 11 in the form of a radio wave, which is digital modulated through the transmitting circuit 6 including the communication control circuit 2, the digital modulation circuit 3, the high-frequency output circuit 4 and the antenna 5 (S4).

The vehicle-carried computer 21 compares the network setting-up code received by the receiving circuit 29 with data that is stored in the identification code data memory 31, and checks if those are coincident with each other (S5).

When those are coincident with each other, the vehicle-carried computer judges that the wireless link is set up, and enters a data exchange mode and starts to transmit and receive necessary data to and from the other party. Based on information indicative of the setting up of the wireless link, the vehicle-carried computer 21 starts to the supply of electric power to the main bodies of the car audio device, the navigation device and the like, which are combined with the vehicle-carried computer 21, and renders the necessary devices active (S6).

When the network setting-up codes are not coincident with each other in the step S3 or S5, it prohibits the necessary system devices from operating (S7).

A network setting-up code for the communication with the vehicle-carried computer 21 is stored in the identification code data memory 11 of FIG. 1. A network setting-up code is entered by numeral keys of the portable telephone set or other suitable means, and stored in the form of a digital signal into a normal semiconductor memory. If the flash memory is used as the semiconductor memory, the data stored therein is retained even in a power saving mode, or a stand-by mode, in which the power consumption by the telephone function is minimized.

To communicate the FIG. 1 vehicle carried computer with the vehicle-carried computer 21, it is necessary to place those devices within a communication range. In connection with this, to reduce the power consumption by the wireless data communication section and to secure a long effective time of the battery of the portable telephone set, it is preferable to reduce the high frequency output power.

If the high frequency output power is set at several mW, those devices may communicate with each other within a communication range of several meters. Accordingly, the communication within the vehicle will go well without a hitch.

Figure 4:
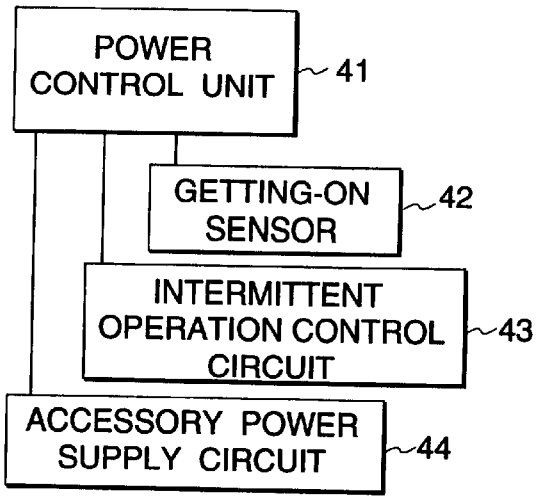
FIG. 4 is a block diagram showing a power control unit for wireless data power transmission, which is used for the vehicle carried device.

FIG. 4 is a block diagram showing a power control unit for the wireless data power transmission, which is used for the vehicle-carried computer 21. The power control unit 41 is connected to a getting-on sensor 42, an intermittent operation control circuit 43, and an accessory power supply circuit 44.

The vehicle wireless data communication system mentioned above is arranged such that, to set up the wireless link, the vehicle-carried computer 21 always sends an inquiry signal at intervals of several seconds. The intermittent sending of the inquiry signal is under control of the intermittent operation control circuit 43. To further lower the power consumption of the vehicle battery, the inquiry signal may be sent at intervals of several seconds from the vehicle-carried computer 21, upon user's getting to the vehicle. In this case, judgement as to if the user gets to the vehicle is based on an output signal derived from the getting-on sensor 42. Specifically, when the driver inserts an engine key to a given key hole and turns it to a position to start the electric power supply to vehicle carried accessories or an engine drive position, the judgement may be made that the driver gets to the vehicle.

In either case, voltage appears on the power line to the accessory devices. Accordingly, the wireless link setting up arrangement may be constructed as follows: The accessory power line voltage is detected. Upon detection of the power line voltage, the wireless data transmission power supply starts. In turn, the intermittent sending of the inquiry signal starts to automatically set up the wireless link.

The getting-on sensor 42, which produces a signal for checking if the user gets to the vehicle, may also be attached so as to detect the opening/closing of the vehicle door. For the same purpose, the getting-on sensor 42 may be a pressure sensor attached to the seat. Further, infrared rays emitted from the human body or the user may be used for the same purpose. Other suitable ways may selectively be employed.

In the embodiment mentioned above, only the network setting-up codes that are stored in the identification code data memories 11 and 31 are used for setting up the wireless link. That is, when those codes are coincident with each other, the wireless link is set up. In an alternative, the personal identification codes that are stored in the personal information data memories 10 and 30 are combined with the network setting-up codes. The wireless link is set up when those codes are coincident with each other.

The network setting-up codes of the identification code data memories 11 and 31 maybe allotted, by rote, to users under a predetermined rule or each group of individuals. The personal identification codes of the personal information data memories 10 and 30 are preferably codes attributed to each individual.

In the wireless-link setting-up arrangement based on the combination of the network setting-up codes and the personal identification codes, more reliable connection will be secured when after the network setting-up codes are coincident with each other and the system is ready for communication, the personal identification code of the party to be communicated is further checked to ascertain if the party is the intended one.

The following situation will occurs. The network setting-up codes are coincident with each other and the system is ready for communication. However, the personal identification codes are not coincident with each other, and the vehicle-carried computer 21 is rendered active. Even in such a situation, the vehicle wireless data communication system visually or audibly presents the connection failure and ends the communication, and then shifts a stand-by mode.

When the system succeeds in the personal identification code verification and the wireless link is set up, it is preferable that the vehicle-carried computer 21 or the portable telephone set audibly or visually presents the verification success to inform the user of it. By so doing, a smooth operation is ensured.

When the wireless link is set up and the individual or user is identified, the system refers to the information that is stored in the personal information data memory 30 of the vehicle-carried computer 21, and presents an appropriate message by reading aloud the name of the user with the aid of the voice output circuit 35 or by automatically displaying personal information of the user's schedule or the like.

Further, the vehicle wireless data communication system refers to the information that is stored in the personal information data memory 30 of the vehicle-carried computer 21, and automatically sets seat positions, inclinations of seat recliners, angles of door mirrors, temperature of the air conditioner, amount of blowing air, and the like in accordance with the personal data.

Additionally, the system utilizes the clocking function of the vehicle-carried computer 21 to store a time when the wireless link is set up, as a vehicle use start time, into a connection-time data memory 34.

The vehicle use start time stored may be transmitted, by utilizing the telephone function of the portable telephone set, to a host computer or the like, and may be used as the vehicle service management.

In this type of the data communication system, a burglarproof mode may be set up. The setting of the burglarproof mode may be removed in a manner that the power switch of the system is turned on, and a pass word is entered to the system by sequentially depressing a plurality of buttons. After removal of the burglarproof mode, the vehicle-carried computer 21 normally operates.

In the embodiment, a person who possesses the portable telephone set is specified the verification of the personal identification codes stored in the personal information data memories 10 and 30. Accordingly, judgement if a person access to the system is an owner of the telephone set is possible. The burglarproof mode may be removed according to the judgement result. If so done, there is no need of the troublesome pass word entering operation.

In a case where the portable telephone set has the telephone function, when the wireless link is set up and a call is automatically terminated at the telephone set, it is desirable to digitize an audio signal, and to wirelessly send it to the vehicle-carried computer 21.

In a case where the vehicle-carried computer 21 includes a voice input means and a voice inputting means, such as a microphone. A called hands free mode may be used in which the user gives a speech not having the portable telephone set in his hand.

Recently, a communication system is proposed which is capable of reporting a traffic accident, when occurs, to a related service center by utilizing the telephone function.

Where the portable telephone set has the telephone function and an emergency reporting service connection function, the vehicle-carried computer 21 automatically sends self vehicle position data, which is detected by the GPS thereof or the like, to the portable device, and in turn the portable device automatically connects to an emergency reporting service.

When the system so arranged is used, the system automatically sends the self vehicle position to the portable device after the wireless link is set up. At the time of emergency, the portable device automatically originates a call to the service center, and the service center recognizes the position of the accidental vehicle.

Since a person may be specified by using the personal identification code, in a case where the portable device has the PDA (personal information assist device, electronic notebook and the like) function, it can share update data with another device by automatically exchanging schedule data and personal information, the stored digital information with another device.

Since a person having gotten to the vehicle is specified by setting up the wireless link, the following operations are possible if the vehicle-carried computer 21 is capable of communicating with a drive-through payment system in which the user, while on the vehicle, is capable of electronically paying the tolls and the prices at expressways, gas stations, drive-through fast food restaurants and the like.

Any of various prepaid card having an IC memory storing electronic money information and credit information and postpaid cards, e.g., a credit cards, is coupled to the portable device to establish the wireless link of it to the vehicle-carried computer 21. Information of part of the personal information on the electronic payment, which are stored in the portable device, such as a kind of the card coupled and a credit limit and others are automatically transmitted to the vehicle-carried computer 21, and stored in an appropriate memory. In an actual electronic payment of the toll at a toll gate of the expressway or the like, it receives an inquiry on the payment information through the electronic payment communication function of the vehicle-carried computer 21 as of an ETC receiver, and then the vehicle-carried computer 21 checks if a payment condition already stored therein is satisfied. If it is payable, the vehicle-carried computer sends payment code information to the portable device through the wireless link already set up. The portable device reads out necessary data from the personal information card already connected thereto, and sends it to the vehicle-carried computer 21. Then, the ETC base station checks if the received data is correct, and if correct, completes the electronic payment.

In the vehicle wireless data communication system described above, the portable device communicates with a specific party alone. If required, the invention may be applied to a vehicle wireless data communication system in which the portable device communicates with an unspecified number of parties through a network. In a case where one vehicle is used by a plurality of persons or a person having a portable device uses a plurality of vehicles, a simple vehicle wireless data communication system may be constructed according to the invention.

In such a case, a plurality of identification codes (network setting-up codes) are contained, and the set up information for different persons are stored for those codes. If required, those network setting-up codes may be associated with the limitations of the device operation.

The system operation to automatically set up the wireless link when the person gets to the vehicle has been described. If necessary, the system may be set in conformity with a case where the person gets off the vehicle.

Specifically, when a person having a portable device leaves the vehicle and moves out of a radio wave arrival range in a state that a wireless link is set up between the portable device and the vehicle-carried computer 21, the wireless link is automatically disconnected. In this case, if the engine is standstill, it may be considered that no person is in the vehicle. Accordingly, the burglarproof mode is automatically set up. In starting up again the vehicle-carried computer 21, if the pass word entered is rejected, the device operation is limited. As a result, the value of a stolen device is reduced to weaken the burglar's will of steal.

When the wireless link is disconnected, it is possible to automatically erase from the memory personal secret information, such as payment information, of the data having come from the portable device. With this function, there is a less chance that the personal secret information, such as payment information, is obtained by other persons. When a time that the wireless link is disconnected is recorded, one can obtain the getting-off time. This may be used as vehicle service management data.

While the present invention has been described using its specific embodiment, it should be understood that the invention is not limited to the embodiment. For example, when the invention is applied to the Bluetooth (simple wireless LAN) whose standardization currently progresses, practical produces of low cost will be realized.

Various functions and services, which require special manipulations, such as burglarproof function, hands free telephone function, PDA data sharing function, automatic payment function, custom operations, vehicle service management data recording, can be automated according to the present invention. Accordingly, the data communication system of good convenience is provided.

What is claimed is:

1. A vehicle wireless data communication system comprising:

a portable device including wireless data communication means and storing means for storing a network setting-up code; and a vehicle carried device including wireless data communication means and storing means for storing a network setting-up code corresponding to said network setting-up code of said portable device, wherein when said portable device approaches to a position within a communication range of said vehicle carried device, an inquiry communication is carried out to compare said network setting-up codes for verification, and when said network setting-up codes are coincident with each other, a wireless link is set up for further data transfer and said vehicle carried device is rendered active.

2. The vehicle wireless data communication system according to claim 1, wherein when said vehicle carried device is rendered active, a burglarproof lock system of said vehicle carried device is removed.

3. The vehicle wireless data communication system according to claim 1, wherein when said portable device has a telephone function, if a call is terminated, a hands free mode is automatically set up.

4. The vehicle wireless data communication system according to claim 1, wherein when said portable device has a telephone function and an emergency reporting service connection function, self vehicle position data, which is detected by a GPS of the vehicle carried computer, is automatically sent to said portable device, and said portable device connects to an emergency reporting service.

5. The vehicle wireless data communication system according to claim 1, wherein when said portable device has a PDA function, said portable device makes a data exchange of at least one of schedule data, personal information, and stored digital information with said vehicle carried device.

6. The vehicle wireless data communication system according to claim 1, wherein when said portable device has a PDA function, said portable device sends at least part of personal information contained in said portable device, to vehicle carried device, and in a payment, payment is carried out based on a verification of the personal identification data by data exchange between said vehicle carried computer and said portable device.

7. The vehicle wireless data communication system according to claim 1, wherein when a wireless link is not set up, an intermittent inquiry communication, triggered from said vehicle carried device, is carried out.

8. The vehicle wireless data communication system according to claim 1, wherein said intermittent inquiry communication is started upon detection of a voltage applied in association with an operation of a vehicle engine key.

9. The vehicle wireless data communication system according to claim 1, wherein said intermittent inquiry communication is started in response to an output signal of a vehicle door opening/closing switch or an output signal of a getting-to-vehicle detecting sensor.

10. The vehicle wireless data communication system according to claim 1, wherein when said vehicle carried device is rendered active, the active state of said vehicle carried device is audibly output.

11. The vehicle wireless data communication system according to claim 1, wherein when said vehicle carried device is rendered active, a message based on personal information recorded in advance is output.

12. The vehicle wireless data communication system according to claim 1, wherein when said vehicle carried device is rendered active, a custom operation of said vehicle carried device, which is based on personal information recorded in advance is output, is set.

13. The vehicle wireless data communication system according to claim 1, wherein when said vehicle carried device is rendered active, a time that said vehicle carried device is rendered active is stored.

14. The vehicle wireless data communication system according to claim 1, wherein said wireless data communication means has a network communication function.

15. The vehicle wireless data communication system according to claim 1, wherein a plurality of network setting-up codes are contained, and different setting-up information are assigned to said plurality of network setting-up codes, respectively.

16. The vehicle wireless data communication system according to claim 1, wherein said plurality of network setting-up codes are associated with device operation limits.

17. The vehicle wireless data communication system according to claim 1, wherein said portable device moves out of a communication range of the vehicle carried device, the wireless link is disconnected and said vehicle carried device is turned off.

18. The vehicle wireless data communication system according to claim 1, wherein said portable device moves out of a communication range of the vehicle carried device, the wireless link is disconnected and a burglarproof lock is set.

19. The vehicle wireless data communication system according to claim 1, wherein said portable device moves out of a communication range of the vehicle carried device, the wireless link is disconnected and part of the personal information which was set when the wireless link is set up.

20. The vehicle wireless data communication system according to claim 1, wherein said portable device moves out of a communication range of the vehicle carried device, the wireless link is disconnected and a time that said portable device is out of the communication range is stored.

21. The vehicle wireless data communication system according to claim 1, wherein said portable device is a removable face plate of said vehicle carried device.

22. The vehicle wireless data communication system according to claim 21, wherein said face plate has a wireless telephone function.

23. The vehicle wireless data communication system according to claim 21, wherein said face plate has a personal information recording function.

24. A vehicle wireless data communication system comprising:

a portable device including wireless data communication means and storing means for storing a network setting-up code; and a vehicle carried device including wireless data communication means and storing means for storing a network setting-up code corresponding to said network setting-up code of said portable device, wherein when said portable device approaches to a position within a communication range of said vehicle carried device, an inquiry communication is carried out to compare said network setting-up codes for verification, and when said network setting-up codes are coincident with each other, a wireless link is set up for further data transfer, and when personal identification codes are coincident with each other, said vehicle carried device is rendered active.

25. The vehicle wireless data communication system according to claim 24, wherein when said vehicle carried device is rendered active, the active state of said vehicle carried device is audibly output.

26. The vehicle wireless data communication system according to claim 24, wherein when said vehicle carried device is rendered active, a message based on personal information recorded in advance is output.

27. The vehicle wireless data communication system according to claim 24, wherein when said vehicle carried device is rendered active, a custom operation of said vehicle carried device, which is based on personal information recorded in advance is output, is set.

28. The vehicle wireless data communication system according to claim 24, wherein when said vehicle carried device is rendered active, a time that said vehicle carried device is rendered active is stored.

29. The vehicle wireless data communication system according to claim 24, wherein said wireless data communication means has a network communication function.

30. The vehicle wireless data communication system according to claim 24, wherein a plurality of network setting-up codes are contained, and different setting-up information are assigned to said plurality of network setting-up codes, respectively.

31. The vehicle wireless data communication system according to claim 24, wherein said plurality of network setting-up codes are associated with device operation limits.

32. The vehicle wireless data communication system according to claim 24, wherein said portable device moves out of a communication range of the vehicle carried device, the wireless link is disconnected and said vehicle carried device is turned off.

33. The vehicle wireless data communication system according to claim 24, wherein said portable device moves out of a communication range of the vehicle carried device, the wireless link is disconnected and a burglarproof lock is set.

34. The vehicle wireless data communication system according to claim 24, wherein said portable device moves out of a communication range of the vehicle carried device, the wireless link is disconnected and part of the personal information which was set when the wireless link is set up.

35. The vehicle wireless data communication system according to claim 24, wherein said portable device moves out of a communication range of the vehicle carried device, the wireless link is disconnected and a time that said portable device is out of the communication range is stored.

36. The vehicle wireless data communication system according to claim 24, wherein said portable device is a removable face plate of said vehicle carried device.

37. The vehicle wireless data communication system according to claim 24, wherein said face plate has a wireless telephone function.

38. The vehicle wireless data communication system according to claim 21, wherein said face plate has a personal information recording function.

* * * * *